US011401947B2

(12) United States Patent
Abdelwahab et al.

(10) Patent No.: US 11,401,947 B2
(45) Date of Patent: Aug. 2, 2022

(54) HYDROGEN CENTRIFUGAL COMPRESSOR

(71) Applicants: Ahmed F. Abdelwahab, Clarence Center, NY (US); David J. Abrahamian, Williamsville, NY (US); Carl L. Schwarz, East Aurora, NY (US); Kang Xu, Williamsville, NY (US)

(72) Inventors: Ahmed F. Abdelwahab, Clarence Center, NY (US); David J. Abrahamian, Williamsville, NY (US); Carl L. Schwarz, East Aurora, NY (US); Kang Xu, Williamsville, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 0 days.

(21) Appl. No.: 17/085,471

(22) Filed: Oct. 30, 2020

(65) Prior Publication Data

US 2022/0136525 A1 May 5, 2022

(51) Int. Cl.

| | |
|---|---|
| ***F04D 29/44*** | (2006.01) |
| ***F04D 17/12*** | (2006.01) |
| ***F04D 29/38*** | (2006.01) |
| ***F04D 29/32*** | (2006.01) |

(52) U.S. Cl.

CPC ..... *F04D 29/444* (2013.01); *F04D 17/12* (2013.01); *F04D 17/122* (2013.01); *F04D 29/321* (2013.01); *F04D 29/38* (2013.01); *F05D 2240/12* (2013.01)

(58) Field of Classification Search

CPC ..... F04D 29/44; F04D 29/444; F04D 29/462; F04D 17/10; F05D 2240/12; F05D 2250/52; F02C 1/02

See application file for complete search history.

(56) References Cited

U.S. PATENT DOCUMENTS

| | | | | | |
|---|---|---|---|---|---|
| 3,588,270 | A * | 6/1971 | Boeks | F04D 29/462 | 415/162 |
| 3,861,826 | A * | 1/1975 | Dean, Jr. | F04D 29/444 | 415/208.4 |
| 4,354,802 | A * | 10/1982 | Nishida | F01D 9/045 | 415/207 |
| 4,824,325 | A * | 4/1989 | Bandukwalla | F04D 29/444 | 415/208.4 |
| 5,152,661 | A * | 10/1992 | Sheets | F01D 5/145 | 415/84 |
| 5,417,547 | A * | 5/1995 | Harada | F04D 29/444 | 415/208.4 |

(Continued)

FOREIGN PATENT DOCUMENTS

| | | | |
|---|---|---|---|
| JP | 61038198 | A | 2/1986 |
| JP | 02275097 | A | 11/1990 |
| WO | 2019160550 | A1 | 8/2019 |

*Primary Examiner* — Michael Lebentritt
*Assistant Examiner* — Brian Christopher Delrue
(74) *Attorney, Agent, or Firm* — lurie A. Schwartz

(57) ABSTRACT

The present disclosure relates to multistage centrifugal high purity hydrogen compressors for compressing low molecular weight fluids. More particularly, the present disclosure relates to the multistage high purity centrifugal hydrogen compressors wherein each stage comprises an vaned diffuser having at least two rows of a plurality of blades.

27 Claims, 6 Drawing Sheets

(56) References Cited

U.S. PATENT DOCUMENTS

| | | | | |
|---|---|---|---|---|
| 6,203,275 | B1 * | 3/2001 | Kobayashi | F04D 17/122 415/199.2 |
| 7,448,852 | B2 | 11/2008 | Abdelwahab et al. | |
| 8,016,557 | B2 * | 9/2011 | Abdelwahab | F04D 29/444 415/208.3 |
| 9,316,228 | B2 * | 4/2016 | Becker | F02C 1/02 |
| 10,393,143 | B2 * | 8/2019 | Kuno | F04D 29/284 |
| 2007/0166149 | A1 * | 7/2007 | Tacconelli | F04D 27/0246 415/160 |
| 2011/0097203 | A1 | 4/2011 | Shibata et al. | |
| 2011/0305558 | A1 | 12/2011 | Omori | |
| 2014/0341706 | A1 * | 11/2014 | Lardy | F04D 25/0686 415/1 |
| 2018/0306203 | A1 * | 10/2018 | Nasir | F02C 6/12 |

* cited by examiner

HYDROGEN CENTRIFUGAL COMPRESSOR

FIELD OF THE INVENTION

The present invention relates generally to centrifugal compressors for compressing low molecular weight fluids. More particularly, the present invention relates to centrifugal compressors for use in the production of high pressure hydrogen gas and supply of high pressure hydrogen gas to a pipeline.

BACKGROUND OF THE INVENTION

Positive displacement compressors have been commonly used for compressing hydrogen. Some of the highest capacity, commercially available, positive displacement compressors used for providing hydrogen at elevated pressures are reciprocating compressors. These compressors are expensive, require substantial foundations, have a high maintenance cost, and turndown inefficiently.

While centrifugal compressors have higher flow capacities than reciprocating compressors, they are not yet in commercial use due to technical challenges in their design and the lack of large quantity markets to justify their development. For example, unlike reciprocating compressors, centrifugal compressors operate on the principle of change in the angular momentum of the fluid, which in the case of a low molecular weight gas, requires very high rotational speeds resulting in very high centrifugal forces and consequently stresses on the compressing element. The technical challenge stems from the requirement to use a high strength material in the rotating compressor element (i.e., impeller) that is not susceptible to hydrogen embrittlement.

Some attempts to manufacture multistage compressors for hydrogen gas have been made in the past. For instance, U.S. Pat. No. 9,316,228 to Becker et al. is directed to a multistage compression system utilizing six serially arranged high-speed (about 60,000 rpm) centrifugal compressors to deliver about 200,000 kg/day of hydrogen gas at a pressure greater than 1,000 psig. The impeller/shaft assembly of each centrifugal compressor has been designed to use differing materials. The six centrifugal compressors described in this patent are driven via a gearbox, each configured to provide a pressure increase ratio of at least 1.20 during normal operation. The multistage compressor described in U.S. Pat. No. 9,316,228, however, does not provide sufficient production of hydrogen gas.

To meet the future needs of the hydrogen infrastructure, advanced high-efficiency compressors that overcome the issues in the art are required. Thus, there is still a need for hydrogen compressors capable of efficiently delivering high volumes of the pressurized hydrogen gas, particularly such a low molecular weight gas. There are still further needs for hydrogen compressors capable of withstanding harsh operating conditions. There is also a need for providing a multistage high purity centrifugal hydrogen compressors wherein each stage comprises an vaned diffuser having at least two rows of a plurality of blades These needs and other needs are at least partially satisfied by the present invention.

SUMMARY

This invention pertains to a centrifugal gas compressor utilizing the principle of angular momentum change to compress low molecular weight fluids such as hydrogen.

In certain aspects, described herein is a multistage centrifugal hydrogen compressor, wherein each stage comprises an airfoil diffuser comprising a plurality of diffuser vanes (hereinafter, "vanes") circumferentially arranged in at least two rows, wherein a first row includes a first number of vanes and a second row comprises a second number of vanes, wherein each of the plurality of vanes in the first row has a solidity value of 1 or greater; and wherein each of the plurality of vanes in the second row has a solidity value of 1 or greater. In still further aspects, the described herein multistage centrifugal hydrogen compressor comprises 2 to 8 stages that are in fluid communication with each other.

Also disclosed herein is a system. In certain aspects, the disclosed system comprises a hydrogen gas compressor includes a plurality of centrifugal compressors fluidly interconnected with one another to form a plurality of sequential stages, wherein each of the plurality of centrifugal compressors comprises the inventive airfoil diffusers and impellers, and wherein the system is configured to provide a pressure increase ratio of about 1.05-1.25 per stage. In still further aspects, disclosed herein is a method of forming a compressed hydrogen gas in the inventive multistage centrifugal hydrogen compressor.

Additional aspects of the invention will be set forth, in part, in the detailed description, figures, and claims which follow, and in part will be derived from the detailed description or can be learned by practice of the invention. It is to be understood that both the foregoing general description and the following detailed description are exemplary and explanatory only and are not restrictive of the invention as disclosed.

BRIEF DESCRIPTION OF THE FIGURES

(FIG. 3A) a schematic of an exemplary two-row diffuser having a first row of blades with a solidity value greater than 1 and a second row of blades with a solidity value greater than 1 as used in one aspect; and (FIG. 3B) a close-up on an exemplary vanes' orientation.

DETAILED DESCRIPTION OF THE INVENTION

Figure 1A:
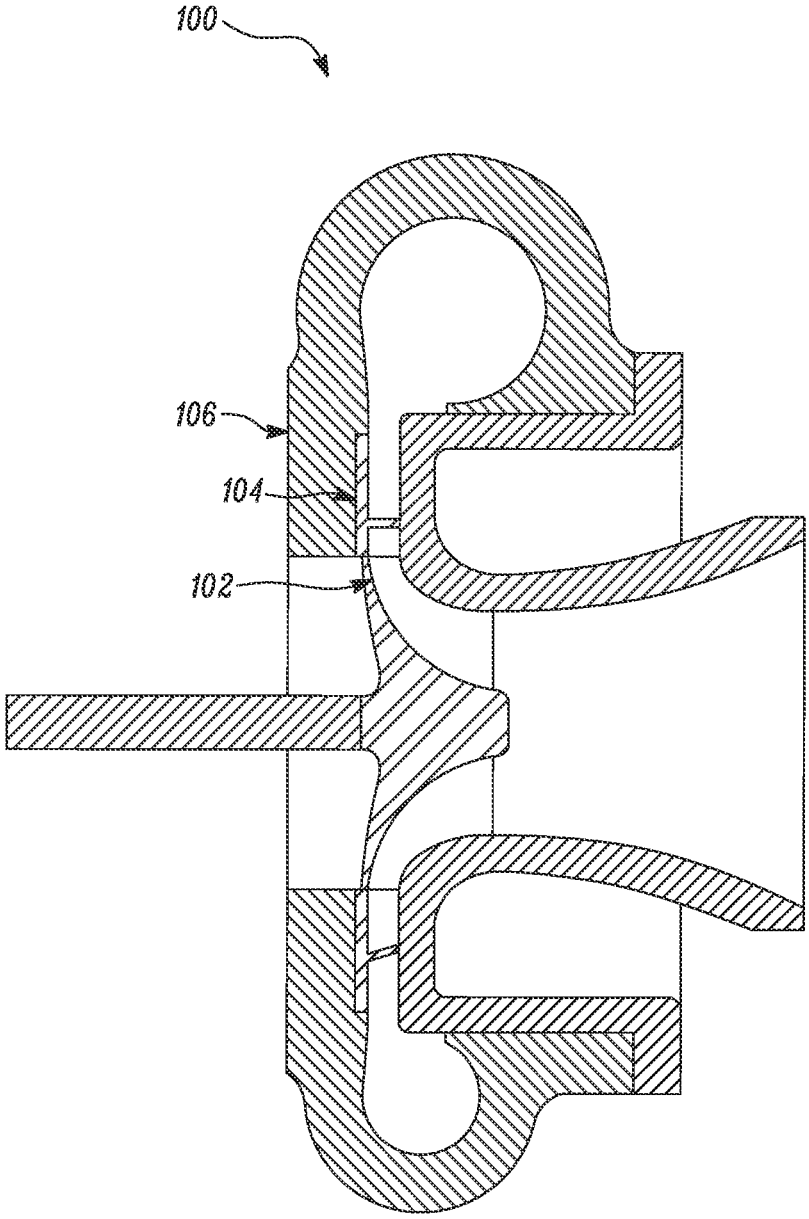
FIGS. 1A-1B depict a general schematic of a side view of an exemplary airfoil diffuser in one aspect (FIG. 1A) and a fragmentary, elevational view of an airfoil diffuser in another aspect (FIG. 1B).

The present invention can be understood more readily by reference to the following detailed description, examples, drawings, and claims, and their previous and following description. However, before the present articles, systems, and/or methods are disclosed and described, it is to be understood that this invention is not limited to the specific or exemplary aspects of articles, systems, and/or methods disclosed unless otherwise specified, as such can, of course, vary. It is also to be understood that the terminology used herein is for the purpose of describing particular aspects only and is not intended to be limiting.

The following description of the invention is provided as an enabling disclosure of the invention in its best, currently known embodiment(s). To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those of ordinary skill in the pertinent art will recognize that many modifications and adaptations to the present invention are possible and may even be desirable in certain circumstances and are a part of the present invention. Thus, the following description is again provided as illustrative of the principles of the present invention and not in limitation thereof.

Definitions

In this specification and in the claims that follow, reference will be made to a number of terms, which shall be defined to have the following meanings:

Throughout the description and claims of this specification the word "comprise" and other forms of the word, such as "comprising" and "comprises," means including but not limited to, and is not intended to exclude, for example, other additives, components, integers, or steps. Furthermore, it is to be understood that the terms comprise, comprising and comprises as they related to various aspects, elements, and features of the disclosed invention also include the more limited aspects of "consisting essentially of" and "consisting of."

As used herein, the singular forms "a," "an" and "the" include plural referents unless the context clearly dictates otherwise. Thus, for example, reference to "a vane" includes aspects having not only one vane but also two or more vanes unless the context clearly indicates otherwise.

Ranges can be expressed herein as from "about" one particular value to "about" another particular value. When such a range is expressed, another aspect includes from the one particular value to the other particular value. Similarly, when values are expressed as approximations, by use of the antecedent "about," it will be understood that the particular value forms another aspect. It should be further understood that the endpoints of each of the ranges are significant both in relation to the other endpoint and independently of the other endpoint.

As utilized herein, 'high purity hydrogen" is a hydrogen gas mixture with a molecular weight of less than 4.0, preferably less than 2.25.

As used herein, the terms "substantially" refers to at least about 80%, at least about 85%, at least about 90%, at least about 91%, at least about 92%, at least about 93%, at least about 94%, at least about 95%, at least about 96%, at least about 97%, at least about 98%, at least about 99%, or about 100% of the stated property, component, composition, or other condition for which substantially is used to characterize or otherwise quantify an amount.

As used herein, the term "solidity value" refers to a ratio between a chord line distance or, in other words, the distance separating a leading edge and a trailing edge of each of the blades of the plurality of blades divided by a circumferential spacing of the blades at the leading edges of the blades. The circumferential spacing and the chord line distance are determined at a specific spanwise location at which the measurement is to be taken, at a hub plate and an outer spanwise shroud plate.

Compressor

A centrifugal compressor compresses fluids using the principle of angular momentum change. In certain aspects, the centrifugal compressor operates by imparting a rotational flow field in a rotating impeller, thereby adding both kinetic and pressure energy to the fluid. This flow field is then de-swirled in a diffuser and collected in a volute or a collector to convert the generated kinetic energy into pressure energy. FIG. 1A depicts a schematic of a side view of the major components of the centrifugal compressor 100, such as an impeller 102, which is driven by a power source, typically an electric motor. The impeller 102 rotates within an inner annular region of a hub plate and adjacent to a shroud.

The impeller 102 is a rotating bladed element that draws the fluid to be compressed through the shroud and redirects the flow at high swirl velocity and pressure in a direction that is generally radial to the direction of rotation of the impeller. A diffuser 104 is located downstream of the impeller within a diffuser passage area defined between the hub plate and an outer portion of the shroud to further recover the pressure in the fluid by de-swirling and decreasing the velocity of the fluid being compressed. The resulting pressurized fluid is directed towards an outlet of the compressor through a volute 106 or a collector.

Unlike a reciprocating compressor where the change of the fluid enthalpy and pressure is done through volume change, the change in enthalpy and pressure in a centrifugal compressor is accomplished through the change in angular momentum of the fluid by a rotating impeller. The relationship between the change of angular momentum of the fluid and the enthalpy change through the compressor stage can be described by the Euler Turbomachine Equation (Eq. 1):

$$(h_{o2}-h_{o1})=U_2V_{\theta 2}-U_1V_{\theta 1} \quad \text{(Eq.1)},$$

wherein U is the impeller speed, $V_\theta$ is the acquired fluid angular velocity, and the subscripts 1,2 denote inlet (eye) and exit (tip) locations of the impeller. The relationship between the enthalpy rise and the temperature rise in an ideal gas can be described as following:

$$(h_{o2}-h_{o1})=\frac{\gamma R}{(\gamma-1)}(T_{o2}-T_{o1}) \quad \text{(Eq. 2)}$$

Further, the temperature rise in an ideal gas can be directly related to the pressure rise as:

$$\frac{p_{o2}}{p_{o1}}=\left(\frac{T_{o2}}{T_{o1}}\right)^{\frac{n}{n-1}} \quad \text{(Eq. 3)}$$

wherein γ is an adiabatic index, T is temperature, P is pressure, and R is a gas constant expressed according to Eq.4.

$$R=\frac{R_{universal}}{\omega} \quad \text{(Eq. 4)}$$

wherein $R_{universal}$ is the universal gas constant, and ω is a molecular weight of a specific fluid.

It is understood based on the equations provided above that the total enthalpy rise (and hence the total pressure rise) in a centrifugal compressor is proportional to the square of the tip speed of the rotating impeller. However, for the same enthalpy rise, as the molecular weight of the fluid decreases (such as in the case of hydrogen), the gas constant "R" and the specific heat of the gas "Cp" increase and hence the rise in temperature and pressure in a compressor stage drops. As a consequence, due to the square-law relationship, this leads to a substantial rise in the required tip speeds of the rotating impellers to achieve any significant pressure rise that in the case of hydrogen as the compressed fluid pushes them against their mechanical strength limit.

Another challenge that arises due to the low molecular weight of hydrogen, and in particular high purity hydrogen is that even though the enthalpy rise per stage is high, the corresponding rise in head pressure is-small compared to a heavier mole weight gas (e.g., air). As a result, an increased number of compressor stages is needed to achieve a reduced overall pressure ratio over a conventional higher molecular weight gas compressor. Each compressor stage comprises an impeller, diffuser, and volute/collector, as shown in FIG. 1A.

An overall pressure ratio of 3:1 can generally be achieved in 10-12 stages of compression using hydrogen, while the same pressure ratio can be achieved in 1-2 stages using air.

While centrifugal compressors generally have higher flow capacities than reciprocating compressors, there are still major challenges in adapting such compressors in commercial use in hydrogen compression due to technical challenges in their design and the lack of large quantity markets to justify their development.

In certain aspects, the present invention is directed to a multistage centrifugal compressor that can compress a high purity hydrogen product at an elevated pressure ratio using serially arranged centrifugal compressor stages. In still further exemplary aspects, the disclosed multistage centrifugal compressor can deliver a high purity hydrogen product using eight serially arranged centrifugal compressor stages.

Without wishing to be bound by any particular theory, it is believed that the ability to reduce the number of stages is achieved by increasing the aerodynamic efficiency of the compressor's individual stages and hence improving the head (pressure rise) capacity per stage. In an exemplary aspect of the present invention, a novel type of a diffuser is employed within each stage of the centrifugal compressor to compress the low molecular weight fluid (e.g., hydrogen) to improve its aerodynamic efficiency.

Figure 8:
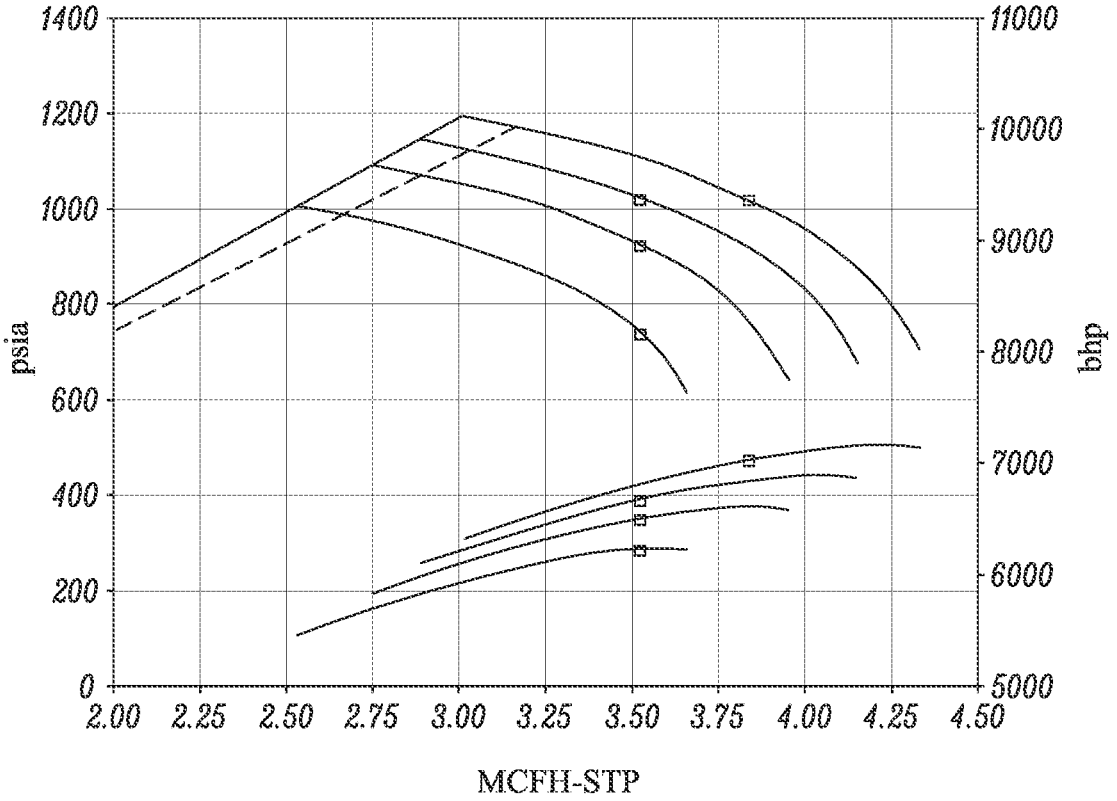
FIG. 8 depicts an exemplary overall performance curve in terms of discharge pressure and brake horsepower of an eight-stage $H_2$ compressor at different inlet pressures.

In still other aspects, the disclosed multistage centrifugal hydrogen compressor exhibits an efficient turndown of at least about 10%, at least about 15%, at least about 20%, at least about 25%, or at least 35% all measured at a constant discharge pressure (as shown in FIG. 8). In still further aspects, the disclosed multistage centrifugal hydrogen compressor exhibits a pressure-rise-to-surge of about 10%, about 15%, or about 20%. In yet other aspects, the disclosed multistage compressor exhibits a pressure-increase ratio over 1.05 per stage and up to 1.25 per stage. It is understood that the pressure-increase ratio, as defined herein, refers to a ratio between a discharge pressure of the multistage compressor and a suction pressure of the multistage compressor. Without wishing to be bound by any particular theory, it is believed that the disclosed properties exhibited by the disclosed multistage compressor are a result of the aerodynamic design of the compressor. In still further aspects, it is understood that such exemplary property can result from the design of the disclosed airfoil diffuser and impeller.

In still further aspects, the use of the disclosed multistage compressor can significantly reduce capital and maintenance costs by reducing the time needed for fieldwork. The disclosed compressor can also reduce cost by requiring a minimal foundation and allowing an incremental turndown resulting in potential power savings over reciprocating compressor installations. It is understood that when compared to a commercially available positive displacement reciprocating compressor, the disclosed multistage centrifugal compressor exhibits higher reliability, and does not require an installed spare.

A. Diffuser

In certain aspects, described herein is a multistage centrifugal hydrogen compressor, wherein each stage comprises an airfoil diffuser comprising a plurality of vanes circumferentially arranged in at least two rows, wherein a first row comprises a first number of vanes and a second row comprises a second number of vanes, wherein each of the plurality of vanes in the first row has a solidity value of 1 or greater; and wherein each of the plurality of vanes in the second row has a solidity value of 1 or greater.

Figure 1B:
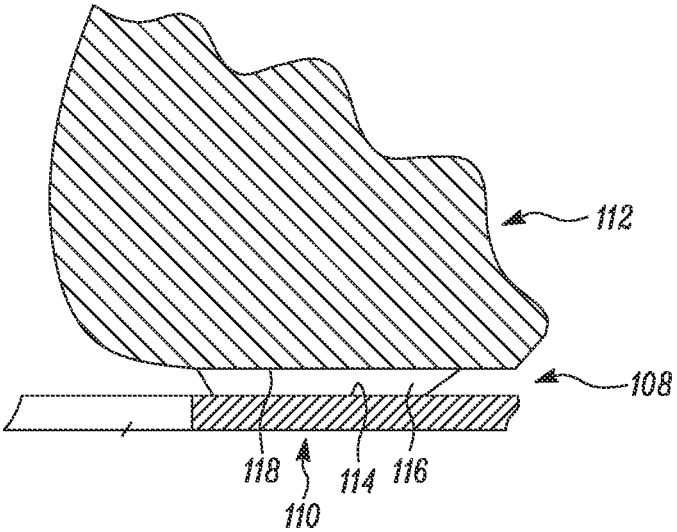

It is understood that in aspects of the present disclosure, the diffuser 108 in FIG. 1B is formed by a diffuser passage area 114 and a plurality of diffuser vanes arranged in multiple rows located within the diffuser passage. The diffuser passage area is defined between a hub plate 110 and a shroud 112 of a stage of the multistage centrifugal hydrogen compressor. The hub plate 110 and the shroud 112 form part of the centrifugal compressor, and each has a generally annular configuration to permit an impeller of the centrifugal compressor to rotate within an inner annular region thereof. A plurality of diffuser vanes 116 are located within the diffuser passage area 114 between the hub plate 110, and the outer portion of the shroud 118 in a circular arrangement and are connected to the hub plate or the outer portion of the shroud (FIG. 1B).

Figure 3A:
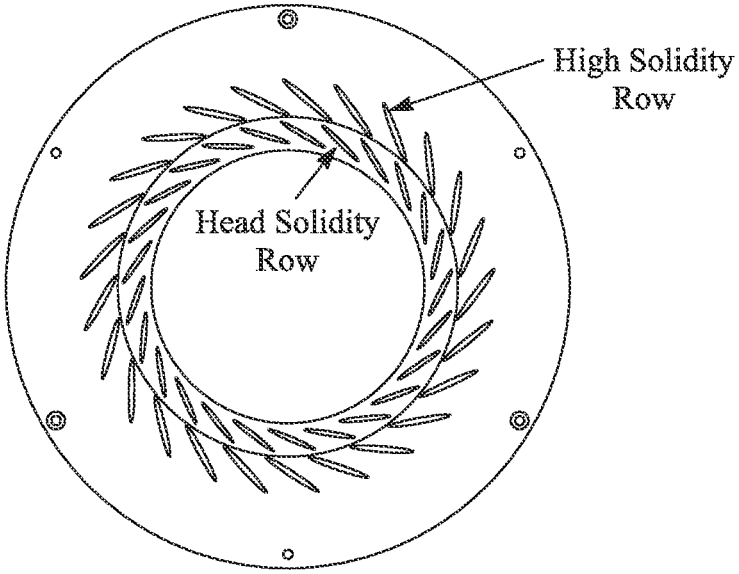
FIGS. 3A-3B depict.
Figure 3B:
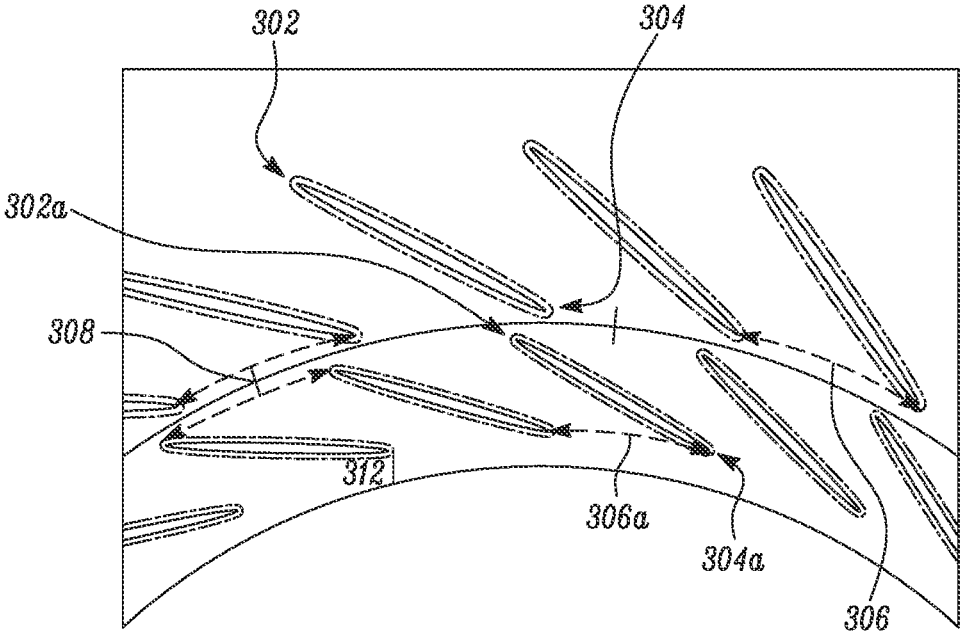

In still further aspects, the airfoil diffuser described herein comprises a plurality of vanes circumferentially arranged in at least two rows, as shown in FIG. 3A-3B. In yet further aspects, the first number of vanes and the second number of vanes are radially displaced from each other. It is understood that any number of vanes can be used to obtain a solidity value greater than 1 in both rows. In certain aspects, the first number of vanes is different from the second number of vanes. In still further aspects, the first number of vanes positioned in the first row is larger than the second number of vanes positioned in the second row. In yet other aspects, the first number of vanes positioned in the first row is smaller than the second number of vanes positioned in the second row.

In still further aspects, the vanes in either row can be present in a twisted (also referred to as a 3-dimensional configuration) or non-twisted (also referred to as a 2-dimensional configuration) configuration. In certain aspects, the first number of vanes can comprise vanes in a twisted configuration. In yet other aspects, the first number of vanes can comprise vanes in a non-twisted configuration. In still further aspects, the second number of vanes can comprise vanes in a twisted configuration. In yet other aspects, the second number of vanes can comprise vanes in a non-twisted configuration. It is understood that when the first number of vanes comprises vanes in a twisted configuration, the second number of vanes can comprise vanes in either twisted or non-twisted configuration. In still further aspects, when the first number of vanes comprises vanes in a non-twisted configuration, the second number of vanes can comprise vanes in either twisted or non-twisted configuration. FIGS. 3A and 3B show an exemplary airfoil diffuser having two rows having a plurality of vanes, wherein both the first number of vanes in the first row and the second number of vanes in the second row are present in a non-twisted configuration.

In certain aspects, each blade of the plurality of vanes in each row has a leading edge 304*a* and 304 (FIG. 3B), a trailing edge 302*a* and 302 (FIG. 3B). It is understood that in some exemplary aspects, the twisted configuration can be in a stacking direction as taken between the hub plate and outer portion of the shroud such that for each of the vanes, the inlet blade angle decreases from the hub plate to the outer portion of the shroud and lean angle in each of the diffuser vanes measured at the hub plate is at a negative value at the leading edge and a positive value at the trailing edge as viewed in the direction of impeller rotation. As used herein the term, "stacking direction" refers to a span-wise direction of each of the plurality of vanes in each row along which any number of airfoil sections are stacked from the hub plate to the outer portion of the shroud. The term "inlet blade angle" means an angle measured between a tangent to a circular arc passing through the vanes at the point of measurement along the leading edge, for example at the hub plate and the outer portion of the shroud, and a tangent to the camber line of the diffuser blade passing through the leading edge thereof. Exemplary twisted configuration of the bladed can be seen in FIGS. 5-7 of U.S. Pat. No. 8,016,557 that is incorporated herein in its entirety.

Figure 7:
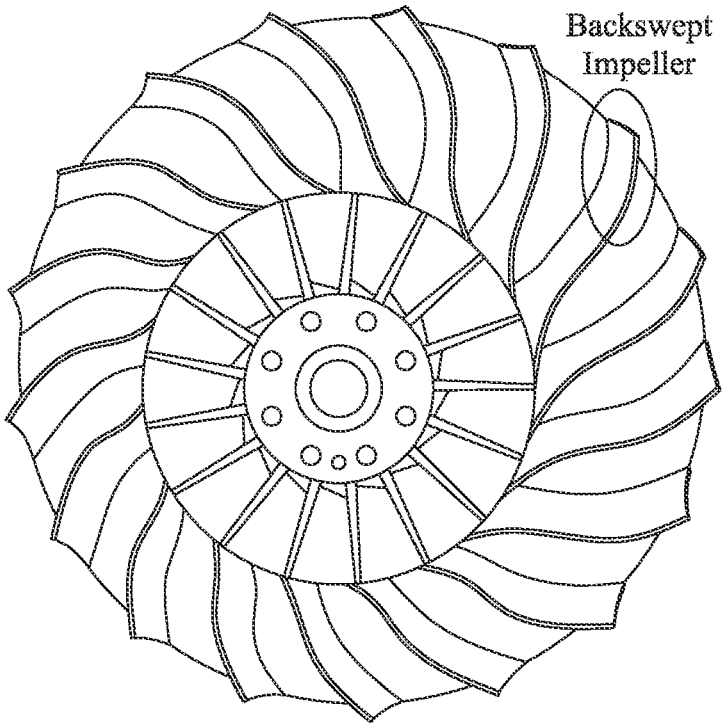
FIG. 7 depicts a backswept impeller used in one aspect.

In certain aspects, the inlet angle can vary in a linear relationship with respect to the stacking direction. In certain aspects, the inlet blade angle can be measured at the hub plate is from about 15 degrees to about 50 degrees, including exemplary values of about 20 degrees, about 25 degrees, about 30 degrees, about 35 degrees, about 40 degrees, and about 45 degrees. In yet other aspects, the inlet blade angle can be measured at the outer portion of the shroud and can be between about 5 degrees and about 25 degrees, including exemplary values of about 10 degrees, about 15 degrees, and about 20 degrees. In still further aspects, each of the vanes in the first row has a lean angle having an absolute value from about 5 degrees to about less than about 75 degrees. As shown in FIG. 7 of U.S. Pat. No. 8,016,557 that is incorporated herein in its whole entirety, for a twisted diffuser, the lean angle changes from the leading edge to the trailing edge of the diffuser, i.e., for the same row. Similarly, in yet other aspects, each of the vanes in the second row has a lean angle having an absolute value from about 5 degrees to about less than about 75 degrees. In certain aspects, the absolute value of the lean angle in both rows is less than about 75 degrees, less than about 70 degrees, less than about 65 degrees, less than about 60 degrees, less than about 50 degrees, less than about 40 degrees, less than about 30 degrees, less than about 20 degrees, less than about 10 degrees or even 0 degree for non-twisted diffusers. In still further aspects, the absolute value of the lean angle is from 0 degrees to non-twisted configurations, to about 5 degrees, about 10 degrees, about 15 degrees, about 20 degrees, about 25 degrees, about 30 degrees, about 35 degrees, about 40 degrees, about 45 degrees, about 50 degrees, about 55 degrees, about 60 degrees, about 65 degrees, or about 70 degrees. In still further aspects, the multiple diffuser rows can overlap or have a gap. In certain embodiments of the invention, a leading edge of each vane in the first row is radially spaced from a trailing edge of the rotating impeller at a distance between 2% to about 35% of the trailing edge radius of the rotating impeller.

In yet another aspects, the leading edges 304*a* of the blades in the first row can be located at a constant offset distance of 312 from the inner circumference of the hub plate. In still further aspects, the offset distance of 308 has an absolute value ranging from about −20% to +20% of the impeller radius.

In still further aspects, the first number of vanes and the second number of vanes of the disclosed airfoil diffuser have a solidity value greater than 1. As disclosed above, the solidity value is measured as the ratio of the blade chord length to the spacing between any two consecutive vanes. Additionally, the solidity value is a term defined for an axial blade row in a cartesian coordinate system as the ratio between the chord length (straight line distance between the leading edge and trailing edge) and the spacing (straight line distance) between two consecutive vanes. When using a radial blade row, a conformal mapping transformation is mathematically performed to calculate the solidity when the radial blade row is mapped on a cartesian coordinate system, i.e., as a ratio between an equivalent blade chord length and the spacing between two consecutive vanes. The solidity value can be mathematically expressed according to Eq. 5:

$$\text{solidity} = \frac{N_{blade} \log\left(\frac{r_2}{r_1}\right)}{2\pi \sin \vartheta} \quad \text{(Eq. 5)}$$

wherein $N_{blade}$ is the number of vanes, $r_1$ is the diffuser inlet radius, $r_2$ is the diffuser exit radius, and θ is the blade stagger angle. The stagger angle, as described herein, is shown in FIG. 1 of U.S. Pat. No. 7,448,852 that is incorporated in its entirety herein.

It is understood that due to the low molecular weight of fluids, such as hydrogen, the conversion of the dynamic head (kinetic energy) exiting the impeller into pressure energy afforded by a single row diffuser is very low. The excessive increase of the diffuser solidity and the use of diffusers with inherently very high solidity values such as wedge diffusers can result in increased aerodynamic losses and reduced efficiency. It is understood that the solidity value does not apply to other types of diffusers, such as wedge diffusers, which are not airfoil based. In yet some aspects, an equivalent solidity value for an equivalent airfoil diffuser as a wedge diffuser, for instance, would be substantially higher than 1, e.g., 4 or 5. Without wishing to be bound by any theory, it is understood that the efficient conversion of enough kinetic energy into pressure energy in the diffuser is needed to ensure an efficient pressure recovery and, consequently, an efficient compressor stage efficiency. Again, without wishing to be bound by any theory, it is hypothesized that if the impeller discharge kinetic energy is not recovered efficiently in the diffuser, it is dissipated (converted into waste heat) in the inter-stage and after-stage piping and coolers reducing the pressure rise capability of the compressor.

In still further aspects, the solidity value of the vanes in the first row and the second row is substantially the same. In yet other aspects, the solidity value of the vanes in the first row and the second row is different. In still further aspects, the solidity value of the vanes in the first row is from 1 to about 5, including the solidity value of about 2, about 3, and about 4. In yet further aspects, the solidity value of the vanes in the second row is from 1 to about 5, including the solidity value of about 2, about 3, and about 4.

Figure 4:
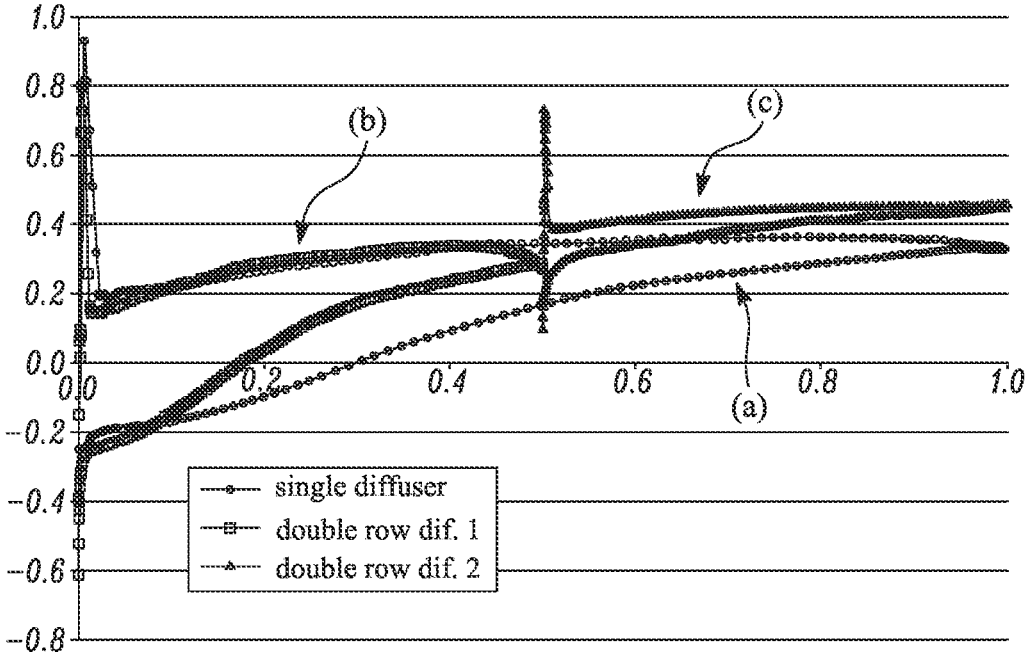
FIG. 4 demonstrates a graph depicting the pressure distribution over the surfaces of a single row diffuser (a) and a two-row diffuser (b) and (c).

FIG. 4 shows a comparison of the blade surface pressure distribution of two types of diffusers designed for the same de-swirl levels and the same inlet conditions. Line (a) in FIG. 4 refers to the pressure distribution in a single diffuser with a solidity value of about 4. Lines (b) and (c) refer to the pressure distribution in the two-row diffuser with the solidity values of about 2. The blade surface pressure distribution can be further described, for example, as pressure distribution along the diffuser pressure surface (the higher pressure side of the curve) and the pressure distribution along the diffuser suction surface (the lower pressure side of the curve). The aerodynamic loading, which is a measure of the amount of diffusion performed by the diffuser on the fluid, which is directly related to the pressure rise and the aerodynamic loss and hence efficiency, is evaluated by computing the area within (inside) each closed-loop curve. As shown in FIG. 4, the aerodynamic loading (the area inside the closed curves) of the two-row diffusers is lower than the single row diffuser. Again, without wishing to be bound by any theory, it is understood that the decrease in the aerodynamic loading in the diffusers having two or more rows of the plurality of vanes results in increased efficiency when compared with the conventional single row diffusers whether they are of the airfoil type or any other type, e.g., wedge diffusers. As can be seen in FIG. 4, the single-row diffuser is not able to achieve the same pressure recovery (exit pressure level) even though it was designed for the same de-swirl levels as the two-row diffuser due to its increased aerodynamic loading and hence reduced efficiency.

In still further aspects, the disclosed diffuser having at least two rows of the plurality of vanes show a substantial increase in the amount of de-swirl (kinetic energy conversion to pressure energy) that can take place in a single row diffuser without substantially impacting the stage efficiency or operating range. In still further aspects, the airfoil diffuser of the present disclosure can exhibit a de-swirl capacity of about 5 degrees to about 25 degrees per diffuser row, including exemplary values of about 6 degrees, about 7 degrees, about 8 degrees, about 9 degrees, about 10 degrees, about 11 degrees, about 12 degrees, about 13 degrees, about 14 degrees, about 15 degrees, about 16 degrees, about 17 degrees, about 18 degrees, about 19 degrees, about 20 degrees, about 21 degrees, about 22 degrees, about 23 degrees, and about 24 degrees per diffuser row.

Figure 2:
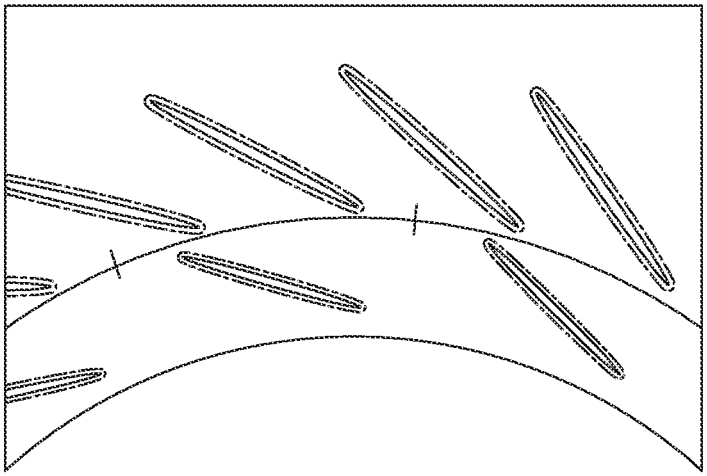
FIG. 2 depicts a conventional two-row diffuser having a first row of vanes with a solidity value of less than 1 and a second row of vanes with a solidity value greater than 1.

While multiple row diffusers have been employed in the related art, it has always included a first row of vanes with a low solidity value (i.e., solidity value less than 1) so as not to impact the operating range of the compressor stage (e.g., prevent diffuser flow choking) and a second row of vanes with a high solidity value to achieve the necessary high-pressure recovery levels in the stage. An exemplary diffuser having a first row of vanes exhibiting a solidity value of less than 1 and a second row of vanes exhibiting a solidity value higher than 1 is shown in FIG. 2. Without wishing to be bound by any particular theory, it is believed that the use of the high solidity value vanes in the first row utilizes the low molecular weight of the compressed gas, which leads to very low Mach numbers leaving the impeller, and thus minimizing the chance of choking and reducing the impact of incidence angle, i.e., the chance of flow separation, on the vanes leading edges, hence minimizing its impact on operating range. In still further aspects, and again without wishing to be bound by any particular theory, it is believed that the unique aspect of low molecular weight fluid can enable the use of high solidity diffusers in the first row, and thus increase the pressure recovery and efficiency of the compressor stage over conventional two-row diffusers with low and high solidity respectively while maintaining high operating range. In yet other aspects, the airfoil diffusers of the present disclosure can provide superior pressure recovery (and hence high efficiency) through increased de-swirl capabilities (conversion of kinetic energy into pressure energy) over the conventional two-row diffusers having low and high solidity values. In still further aspects, the airfoil diffusers of the present disclosure provide superior performance over a single row diffuser by distributing the increased de-swirl schedule over the two rows instead of one (FIG. 4). In still further aspects, the use of two high solidity value diffuser rows in a low molecular weight application, such as hydrogen, does not impact the operating range of the compressor stage. Again, without wishing to be bound by any particular theory, the efficient operating range of the compressor stage is attributed to the exceedingly high speed of sound in such a low molecular weight fluid, i.e., the low Mach number of the fluid which gives the high solidity diffuser a large operating range which in combination with the improved aerodynamic loading of the two-row high solidity diffuser design can result in a high-pressure recovery capability and hence high efficiency of the compressor stage.

Figure 5:
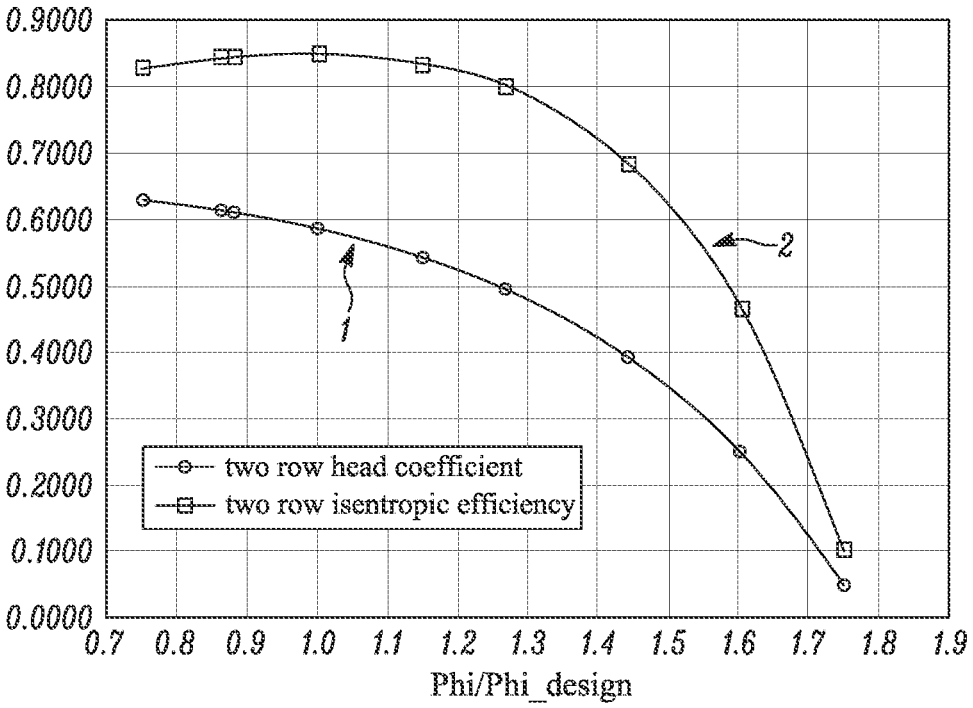
FIG. 5 depicts an exemplary data of a head coefficient (1) and isentropic efficiency (2) measured for a two-row diffuser.

FIG. 5 depicts the non-dimensionalized performance test curves of a two-row high solidity diffuser stage test at hydrogen corrected speed.

Figure 6:
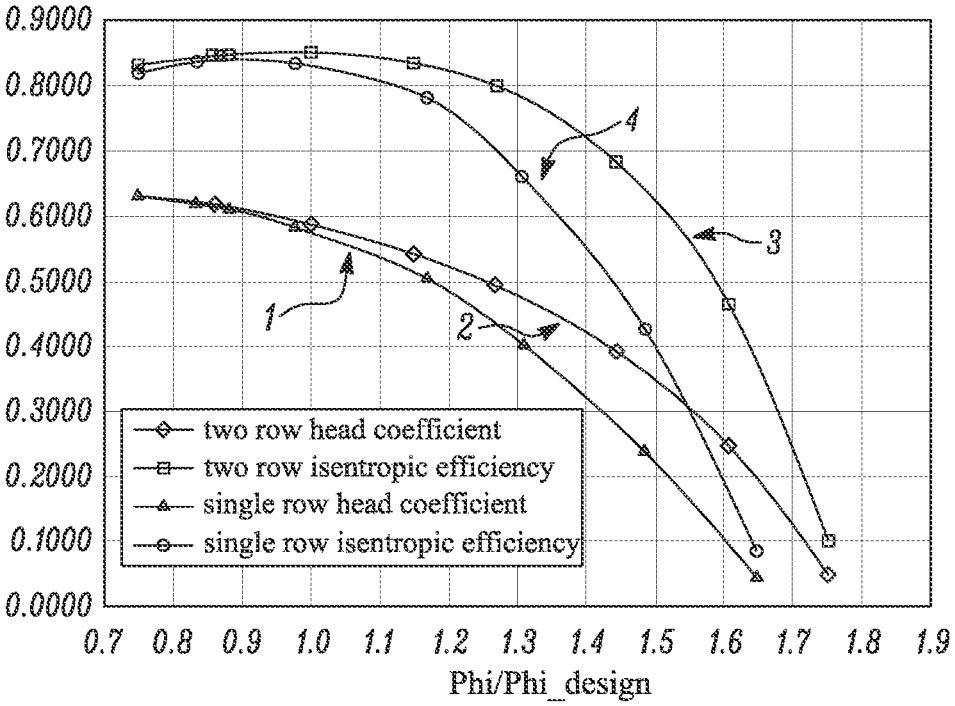
FIG. 6 depicts an exemplary data of a head coefficient and isentropic efficiency measured for a single row diffuser (1,4) and two-row diffuser (2,3).

FIG. 6 shows the exemplary laboratory test data of an exemplary compressor stage for both single and two-row diffuser. The vertical axis represents the head coefficient and isentropic efficiency. The head coefficient represents the pressure rise of the compressor stage non-dimensionalized by the impeller tip speed U. For an ideal gas, this can be expressed by Eq.6:

$$\text{Head coefficient} = \frac{\gamma R\ T_{o1}}{(\gamma-1)\ U^2}\left(\left(\frac{P_{o2}}{P_{o1}}\right)^{\left(\frac{\gamma-1}{\gamma}\right)} - 1\right) \quad \text{(Eq. 6)}$$

The vertical axis also represents the isentropic efficiency of the compressor stage. For an ideal gas, the isentropic efficiency is expressed as:

$$\text{Isentropic efficiency} = \frac{\left(\left(\frac{P_{o2}}{P_{o1}}\right)^{\left(\frac{\gamma-1}{\gamma}\right)} - 1\right)}{(T_{o2} - T_{o1})} \quad \text{(Eq. 7)}$$

The isentropic efficiency is obtained by measuring the inlet and discharge pressures and temperatures of the compressor stage and then applying Eq. 7 above at every measure flow point (phi).

The horizontal axis represents a normalized flow coefficient (phi/phi design) where phi is the inlet volume flow rate of the compressor stage non-dimensionalized by the impeller tip speed U as shown in Eq. 8:

$$phi = \frac{Q_{inducer}}{A_{inducer}\ U} \quad \text{(Eq. 8)}$$

wherein Q and A are the volume flow rate and the cross-sectional area at the impeller inducer/inlet, respectively. This type of curve is used to show the operating range of the compressor stage in terms of the turn downrange from a peak efficiency point (down to surge point) as well as the turn up range (up to lowest measurable head coefficient) in terms of the operating flow range (phi).

In certain aspects, and as described herein, the use of high solidity diffusers in a low molecular weight application does not impact the operating range of the compressor stage exhibiting turndown, such as, for example, about 25%, and a substantial turn up range. In still further aspects, the two-row high solidity diffuser shows superior performance over the single row high solidity diffuser both in head and efficiency. In still exemplary aspects, the efficiency improvement at the described design flow conditions is about 1% points, about 2% points, about 3% points, about 4% points, about 5% points, or even about 10% points. In yet other aspects, the improvement in performance increases substantially at higher flow coefficients (higher flows). Without wishing to be bound by any particular theory, it is believed that the improvement in performance at higher flow coefficients is primarily due to the ability of the two-row diffuser to maintain high-pressure recovery capabilities over single row diffuser increasing the compressor head and hence efficiency the over single row high solidity diffuser.

Through extensive analysis, the inventors have demonstrated that a single row high solidity diffuser, with a solidity equivalent to the combined solidity of the two-row diffuser, or the use of an inherently high solidity diffuser did not achieve the same level of efficiency as this two-row high solidity value diffuser (FIG. 2 and FIG. 3). Again, without wishing to be bound by any particular theory, it is understood that the high efficiency of the disclosed diffusers is, in part, due to the amount of de-swirl required to achieve high-pressure recovery in a hydrogen compressor. The required amount of total de-swirl to effect a substantial pressure recovery in the diffuser (conversion of kinetic energy into pressure) is about 20 to 50 degrees of de-swirl, including exemplary values of about 25 degrees, about 30 degrees, about 35 degrees, about 40 degrees, and about 45 degrees swirl. This could not be efficiently achieved in a single diffuser.

As shown in FIG. 6, the overall isentropic efficiency is measured for both a single and double row high solidity diffusers designed for the same overall de-swirl angle and the same impeller. The plots clearly show the superiority of the double row high solidity diffuser proposed in this invention over the single row diffuser. In certain aspects, the current disclosure utilizes the nature of the low molecular weight of the compressed gas to use a two-row diffuser that has a very high de-swirl capacity through the use of high solidity value diffusers (solidity higher than 1) in both rows that can provide a high-pressure recovery without impacting the aerodynamic efficiency of the diffuser and hence improve the overall performance of the compressor stage.

B. Impeller

In still further aspects, the disclosed multistage centrifugal hydrogen compressor comprises an impeller. In still further aspects, each stage of the multistage compressor comprises an impeller. In such exemplary aspects, the impeller can be mounted on a rotatable shaft positioned within a stationary housing.

In still further aspects, the impeller is backswept, as shown in FIG. 7. The use of the backswept impeller allows achieving a proper rise-to-surge pressure for the lightweight gas ($H_2$). It is understood that a conventional radial design impeller would not provide the rise-to-surge pressure that is needed because low molecular weight gases have a low-pressure ratio per stage. In still further aspects, the impeller is mounted on a shaft, wherein the impeller has a first edge of a gas flow path from an inlet section to an outlet section, wherein the inlet section is oriented axially to the shaft and said outlet section is oriented radially to the shaft. In certain aspects, a plurality of inducer blades on the impeller in the inlet section, where the inducer blades are stacked along the radial direction to the shaft and oriented to impart work on the hydrogen fluid, routed through the flow path by deflecting it in a tangential direction, thus changing its angular momentum. In yet other aspects, a plurality of exit blades on the impeller in the outlet section of the exit blades, stacked along the axial direction to the shaft and distributed tangentially at a backswept angle to the radial direction to impart work on fluid passing through the flow path by accelerating it, and an shroud proximate both the inducer blades and the exit blades and defining a second edge of the gas flow path.

Methods

In still further aspects, described herein is a method of forming a compressed high purity hydrogen gas in the disclosed multistage hydrogen compressors. It is understood that the disclosed methods can comprise the use of any of the disclosed multistage high purity hydrogen compressors. In still further aspects, the methods disclosed herein provide a pressure increase ratio ranging from about 1.05 to 1.25 per stage of hydrogen being compressed. It is understood that the pressure increase ratio, as defined herein, refers to a ratio between a discharge pressure and a suction pressure.

In still further aspects, the methods of the present disclosure comprise the compressors comprising any of the disclosed parts. In certain aspects, the multistage compressors used in the present disclosure comprises greater than 2 stages, wherein each stage comprises an airfoil diffuser comprising a plurality of vanes circumferentially arranged in at least two rows, wherein a first row comprises a first number of vanes and a second row comprises a second number of vanes, wherein each of the plurality of vanes in the first row has a solidity value of 1 or greater; and wherein each of the plurality of vanes in the second row has a solidity value of 1 or greater.

The above specification provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the devices are not intended to be limited to the particular forms disclosed. Rather, they include all modifications and alternatives falling within the scope of the claims, and embodiments other than the one shown may include some or all of the features of the depicted embodiment. For example, components may be omitted or combined as a unitary structure, and/or connections may be substituted. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

What is claimed is:

1. A multistage centrifugal low molecular weight high purity hydrogen compressor, wherein each stage comprises a diffuser comprising:

a plurality of vanes circumferentially arranged in at least two rows, wherein a first row comprises a first number of vanes and a second row comprises a second number of vanes, wherein each of the plurality of vanes in the first row has a solidity value of 1 or greater; and wherein each of the plurality of vanes in the second row has a solidity value of 1 or greater, where the solidity is mathematically expressed as $$\text{solidity} = \frac{N_{blade} \log\left(\frac{r_2}{r_1}\right)}{2\pi \sin \vartheta}$$

and $N_{vane}$ is the number of vanes, $r_1$ is the diffuser inlet radius, $r_2$ is the diffuser exit radius, and θ is the vane stagger angle, wherein said solidity is a conformal mapping transformation performed to calculate the solidity when the radial vane row is mapped on a cartesian coordinate and takes into account the vane stagger angle θ.

2. The multistage centrifugal hydrogen compressor of claim 1, wherein the diffuser is formed by a diffuser passage area defined between a hub plate and a shroud of a stage of the multistage centrifugal hydrogen compressor.

3. The multistage centrifugal hydrogen compressor of claim 1, wherein the first number of vanes and the second number of vanes are radially displaced from each other.

4. The multistage centrifugal hydrogen compressor of claim 1, wherein the count of the first number of vanes is different from the second number of vanes.

5. The multistage centrifugal hydrogen compressor of claim 1, wherein the count of the first number of vanes is larger than the second number of vanes.

6. The multistage centrifugal hydrogen compressor of claim 1, wherein the count of the first number of vanes is smaller than the second number of vanes.

7. The multistage centrifugal hydrogen compressor of claim 1, wherein the count of the first number of vanes is the same as the second number of vanes.

8. The multistage centrifugal hydrogen compressor of claim 1, wherein the first number of vanes comprises vanes in a twisted configuration.

9. The multistage centrifugal hydrogen compressor of claim 8, wherein the second number of vanes comprises vanes in a non-twisted configuration.

10. The multistage centrifugal hydrogen compressor of claim 8, wherein the second number of vanes comprises vanes in the twisted configuration.

11. The multistage centrifugal hydrogen compressor of claim 1, wherein the first number of vanes comprises vanes in a non-twisted configuration.

12. The multistage centrifugal hydrogen compressor of claim 11, wherein the second number of vanes comprises vanes in a twisted configuration.

13. The multistage centrifugal hydrogen compressor of claim 11, wherein the second number of vanes comprises vanes in the non-twisted configuration.

14. The multistage centrifugal hydrogen compressor of claim 8 utilizes the first number of vanes, wherein the twisted configuration is defined by a twist about a line generally extending in a stacking direction that passes through the aerodynamic center of each vane.

15. The multistage centrifugal hydrogen compressor of claim 8 utilizes the first number of vanes, wherein the twisted configuration is defined by a twist about a line generally extending in a stacking direction that does not pass through the aerodynamic center of each vane.

16. The multistage centrifugal hydrogen compressor of claim 1, wherein a leading edge of each vane in the first row is radially spaced from a trailing edge of the rotating impeller at a distance between 2% to about 35% of the trailing edge radius of the rotating impeller.

17. The multistage centrifugal hydrogen compressor of claim 1, wherein a trailing edge of each vane in the first row is radially spaced from a leading edge of each vane in the second row at a distance between −20% to about 20% of the trailing edge radius of the first row diffuser vane.

18. The multistage centrifugal hydrogen compressor of claim 1, wherein each of the vanes in the first row has a absolute lean angle from about 0 degrees to about 75 degrees.

19. The multistage centrifugal hydrogen compressor of claim 1, wherein each of the vanes in the second row has a absolute lean angle from about 0 degrees to about 75.

20. The multistage centrifugal hydrogen compressor of claim 1, wherein a chord length of each vane in the first row and a chord length of an adjacent vane in the second row is the same or different.

21. The multistage centrifugal hydrogen compressor of claim 1, wherein the solidity value of the vanes in the first row and the solidity value of the vanes in the second row are substantially the same.

22. The multistage centrifugal hydrogen compressor of claim 1, wherein the solidity value of the vanes in the first row and/or second row is greater than 1 to about 5.

23. The multistage centrifugal hydrogen compressor of claim 1, wherein the vane diffuser in each stage reduces the swirl by 5 degrees to about 25 degrees per diffuser row.

24. The multistage centrifugal hydrogen compressor of claim 1 comprising 2 to 8 stages that are in fluid communication with each other.

25. The multistage centrifugal hydrogen compressor of claim 1, wherein the compressor is configured to provide a pressure increase ratio greater than 1.2 to hydrogen being compressed.

26. The multistage centrifugal hydrogen compressor of claim 1, wherein each stage further comprises an impeller.

27. The multistage centrifugal hydrogen compressor of claim 25, wherein the impeller is a backswept impeller.

* * * * *